US005518238A

United States Patent [19]

Hu et al.

[11] Patent Number: 5,518,238

[45] Date of Patent: May 21, 1996

[54] STREET HOCKEY PUCK

[75] Inventors: Antonio C. Hu, San Francisco, Calif.; Albert Yiu-So, Calgary, Canada

[73] Assignee: Primal Products, Inc., San Francisco, Calif.

[21] Appl. No.: 502,164

[22] Filed: Jul. 13, 1995

[51] Int. Cl.[6] ..... A63B 71/04

[52] U.S. Cl. ..... 273/128 R

[58] Field of Search ..... 273/128 R, 128 A, 273/128 CS, 126 R, 126 A, 57.2

[56] References Cited

U.S. PATENT DOCUMENTS

| | | | |
|---|---|---|---|
| 1,305,535 | 6/1919 | Grabowiecki . | |
| 2,727,744 | 12/1955 | Watson . | |
| 2,812,222 | 11/1957 | Gussack . | |
| 3,117,788 | 1/1964 | Buonanno et al. . | |
| 3,465,843 | 9/1969 | Guinot . | |
| 3,675,928 | 7/1972 | Gentile . | |
| 3,726,526 | 4/1973 | Radovich . | |
| 3,784,204 | 1/1974 | Felber . | |
| 3,789,947 | 2/1974 | Blumrich . | |
| 3,997,164 | 12/1976 | White, Sr. . | |
| 4,078,801 | 3/1978 | White, Sr. . | |
| 4,111,419 | 9/1978 | Pellegrino . | |
| 4,153,253 | 5/1979 | White, Sr. . | |
| 4,715,460 | 12/1987 | Smith . | |
| 4,754,973 | 7/1988 | Kunick . | |
| 4,793,769 | 12/1988 | Dolan . | |
| 4,801,144 | 1/1989 | De Masi, Jr. et al. . | |
| 4,878,668 | 11/1989 | Nevoral . | |
| 5,014,990 | 5/1991 | Kaser et al. . | |
| 5,149,096 | 9/1992 | Keating et al. | 273/128 R |
| 5,184,820 | 2/1993 | Keating et al. . | |
| 5,240,251 | 8/1993 | Filice . | |
| 5,246,238 | 9/1993 | Brown . | |
| 5,269,520 | 12/1993 | Vellines . | |
| 5,275,410 | 1/1994 | Bellehumeur et al. . | |
| 5,288,072 | 2/1994 | Hsieh . | |
| 5,346,214 | 9/1994 | Bruhm . | |
| 5,366,219 | 11/1994 | Salcer et al. . | |
| 5,429,360 | 7/1995 | Capecci, Jr. | 273/128 R |

FOREIGN PATENT DOCUMENTS

| | | | |
|---|---|---|---|
| 2046957 | 1/1992 | Canada | 273/128 R |

*Primary Examiner*—Raleigh W. Chiu
*Attorney, Agent, or Firm*—Limbach & Limbach

[57] ABSTRACT

A street or roller hockey puck that includes a plurality of rotational members that are supported in a ring configuration. The rotational members can be cylindrical wheels or spherical rollers. The preferred embodiment includes wheels each having an axis of rotation that is perpendicular to a plane that contains both the central axis of the ring configuration and a radius formed between the central axis and each wheel. An alternate embodiment includes spherical rollers that freely rotate within a housing and protrude through the circumferential side of the puck and at least through one of the top and bottom surfaces.

25 Claims, 6 Drawing Sheets

STREET HOCKEY PUCK

FIELD OF THE INVENTION

The present invention relates to hockey pucks, and in particular to a hockey puck for playing street or roller hockey on a paved surface.

BACKGROUND OF THE INVENTION

For the past several years, street and roller hockey has been the fastest growing team sport in the United States. Street hockey is played on a paved surface, such as asphalt or concrete. Such a surface is cheaper and more accessible than playing ice hockey in an ice rink. Street hockey is typically played with a hockey stick and either a ball or a plastic puck similar in appearance to an ice hockey puck. Roller hockey is the same as street hockey, but the players wear roller skates or in-line skates.

With the advent of the in-line skate, there is a trend to make roller hockey "feel" more like ice hockey. The challenge has been to make a ball or puck travel on the rough paved surface such that the players can pass and shoot with the same "feel" as if playing with an ice hockey puck on a relatively frictionless ice surface. There has been only limited success with the use of balls and specially made roller hockey pucks.

A plastic ball rolls relatively well over a rough paved surface. The ball, however, tends to bounce too much and reacts to the hockey stick in an unpredictable manner. Hockey players complain they cannot "dribble" the ball because the rolling ball skips and bounces unpredictably off of the stick and the playing surface.

Therefore, there has been a number of puck shaped devices that have attempted to capture the ice hockey feel in a roller hockey puck. Most of these designs attempt to address the three biggest problems with a traditionally shaped puck being played on a paved surface. The first problem is how to reduce the friction between the puck and the paved surface so the puck travels more like it were on ice. The second problem is how to reduce the tendency of a puck to flip about when an edge of the puck catches an irregularity in the playing surface. When a puck flips, it becomes difficult to control and may begin rolling. The third problem is how to reduce the tendency of a puck to roll on its end or edge, and provide a puck that is easier to knock down flat onto the paved playing surface after it does begin to roll. Once a puck starts rolling on its end or edge on a paved surface, it is quite difficult to knock the puck down to a flat orientation again.

There are several prior art devices that have employed different techniques to address the problem of high friction between the puck and the paved surface. Different substances have been mounted on the puck's flat surfaces to reduce friction, such as bristle material as shown in U.S. Pat. No. 5,240,251, or runners or bosses as shown in U.S. Pat. No. 5,288,072 and U.S. Pat. No. 5,275,410. These pucks do reduce the friction such that play on a very smooth paved surface begins to approach the feel of an ice hockey puck played on ice. However, a rougher surface renders these pucks nearly useless. The runners, bosses, and edges catch on surface irregularities, slowing the puck down and sending it flipping and bouncing out of control.

Other prior art pucks have incorporated spherical rollers that protrude through both flat surfaces of the puck, as shown in U.S. Pat. No. 4,801,144 and U.S. Pat. No. 4,793, 769. While the spherical rollers help to reduce the friction between the puck and the playing surface, there is generally too much friction between the rollers and the puck body for the rollers to work effectively, especially if there is debris trapped within the body. The relatively large contact surface of the rollers with the puck body tends to bind the rollers, resulting in the rollers dragging along the playing surface rather than rolling. This configuration of the rollers also allows the puck to tilt relative to the playing surface, which can result in an edge catching and flipping the puck. Further, these puck designs do not address the tendency of the puck to roll on its side or edge.

There are prior art designs that specifically address the problem of the puck's tendency to roll on its side or edge. These puck designs employ inserts, metal studs, and protrusions on the circumferential side of the puck, as shown in U.S. Pat. No.'s 3,114,788, 4,111,419, and 5,275,410. Experimentation has shown that for inserts, studs, or protrusions to be effective in roll prevention, they need to be extremely large relative to the puck or placed in an asymmetric configuration. Such large or asymmetric features would significantly alter the behavior and feel of the puck. In addition, these inserts, studs and protrusions only help knock down a puck once it starts rolling on its side. They do not prevent such rolling in the first place. Further, these pucks can roll on one edge of the circumferential side of the puck at such an angle that the inserts, studs and protrusions are rendered ineffective. Finally, these studs and protrusions do not address the problem of reducing the friction between the puck and the playing surface.

There is a need for a street hockey puck that has the feel of an ice hockey puck being played on ice, while simultaneously preventing the puck from rolling on its edge or side.

SUMMARY OF THE INVENTION

The present invention solves the aforementioned problems by providing reduced friction between the puck and the playing surface, while preventing the puck from rolling on its edge or side.

The puck of the present invention includes a plurality of rotatable members which project through the side or circumferential surface of the puck and neither, one, or both of the top and bottom surfaces of the puck.

In a preferred embodiment, the rotational members are wheels supported in a ring configuration. Each wheel has an axis of rotation that is substantially perpendicular to a plane that contains both the central axis of the puck and a radius formed between the central axis and the wheel.

In another aspect of the invention, spherical cavities are formed by the puck housing, wherein spherical rollers freely rotate and protrude through the side surface of the puck and one or both of the top and bottom surfaces of the puck.

In yet another aspect of the present invention, wheels are mounted directly on a ring to form the puck.

Other objects and features of the present invention will become apparent by a review of the specification, claims and appended figures.

DETAILED DESCRIPTION OF THE PREFERRED EMBODIMENTS

The present invention is a street hockey puck that slides over rough paved surfaces with reduced friction while reducing the likelihood of the puck rolling on its side or edge.

Figure 1:
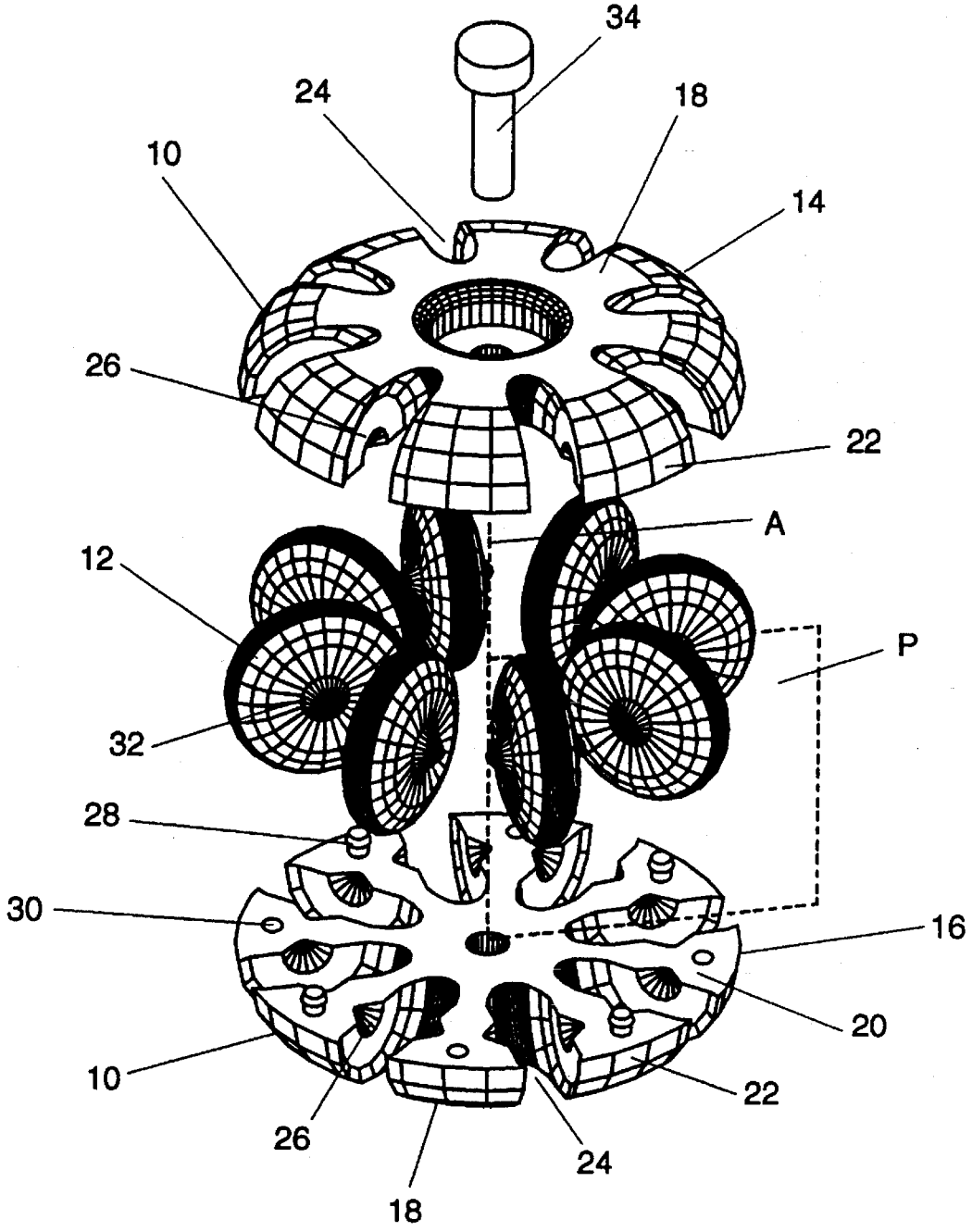
FIG. 1 is an exploded perspective view of the preferred embodiment of the present invention.
Figure 2:
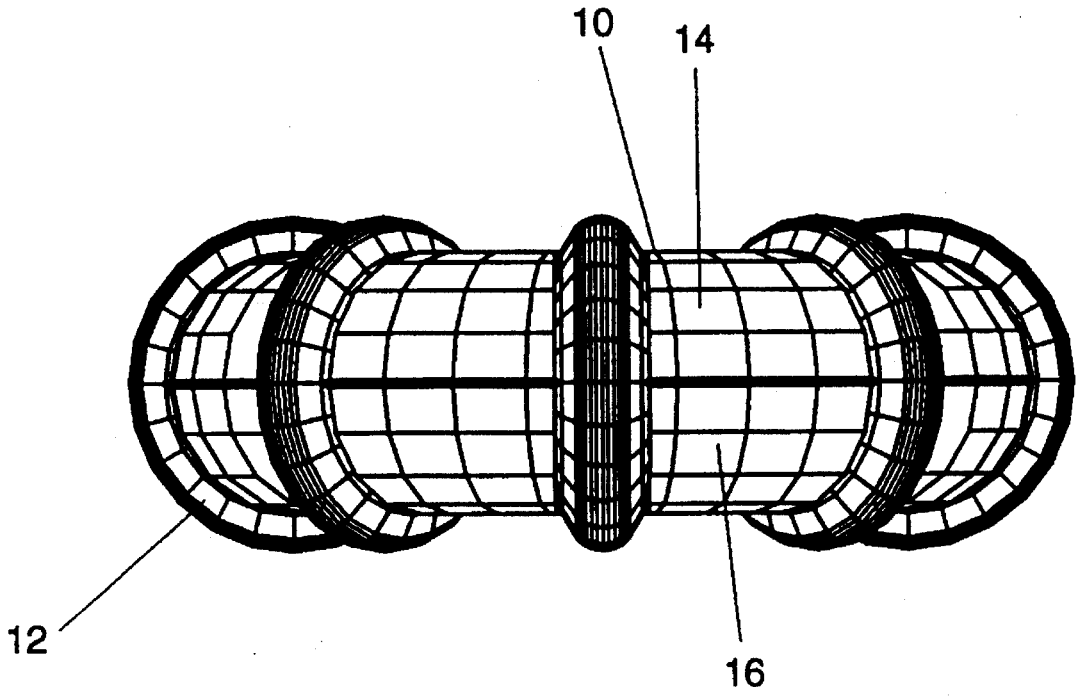
FIG. 2 is a side elevational view of the preferred embodiment of the present invention.

The street hockey puck of the preferred embodiment is illustrated in FIGS. 1 and 2. The puck includes a housing 10 and rotatable members which in the preferred embodiment take the form of wheels 12.

The housing 10 includes two cylindrically shaped housing sections 14 and 16, each having an outer planar surface 18, an inner planar surface 20, and a radially peripheral side surface 22. The outer planar surfaces 18 form the top and the bottom of the puck, and the inner surfaces 20 abut on another when the housing sections 14/16 are assembled together. The housing 10 is molded with an elastomeric material, such as polyurethane or polyethylene with vinyl or polyvinyl chloride, to more closely approximate the feel of a rubber ice hockey puck. Each housing section 14/16 has a plurality of slots 24 extending radially inward from the side surface 22. The slots 24 extend through the outer planar surfaces 18 and the inner planar surfaces 20. Conical axle cavities 26 are formed in the inner planar surfaces of housing sections 14/16 opposing one another across each slot 24. Male snaps 28 extend out from the inner planar surface 20 of housing sections 14/16 near the side surface 22. Female snaps 30 are formed in housing sections 14/16 opposing the male snaps 28 to receive the male snaps 28 when the housing sections 14/16 are assembled together.

Wheels 12 are cylindrical in shape, and have conical wheel axles 32 on each side wall thereof. Wheels 12 are molded from a hard plastic, such as nylon. The hard plastic provides low friction between the wheel 12 and the housing sections 14/16, and between the wheels 12 and the paved playing surface. Preferably, the hard plastic includes a filler, such as glass. The filler material provides increased abrasion-resistance.

To assemble the street hockey puck, conical axles 32 of wheels 12 are placed in the conical axle cavities 26 such that the wheels rotate in planes which extend radially outward from the center of the puck and which contain the central axis A of the wheel support structure. In FIG. 1, one such plane P for one wheel is shown. The housing sections 14 and 16 are pressed together whereby the opposing conical axle cavities 26 engage and secure the conical axles 32 in the puck. The dimensions of the conical axle cavities 26 are slightly larger than the conical axles 32, so axles 32 freely spin in cavities 26. The housing sections 14/16 are held together by a fastener 34, such as a screw, snap, annular snap, bolt, or rivet, located near the center of the puck. Male snaps 28 engage female snaps 30 to secure the outer circumference of the housing sections 14 and 16 together.

When assembled, wheels 12 spin freely in slots 24 about their conical axles 32. The conical axles 32 and cavities 26 provide point contacts between each wheel 12 and the puck housing 10, which results in low friction. Low friction can also be achieved with cylindrical axle pins of small diameter. However, the conical axles are much stronger and less prone to breakage than axle pins. Furthermore, when the puck is struck with a stick, the relatively large surface area of the conical axles 32 helps to distribute the force of impact to the elastomeric housing 10 of the puck. The wheels 12 are dimensioned such that they extend out of slots 24 through outer planar surfaces 18 and the side surface 22.

The puck exhibits excellent horizontal travel on paved playing surfaces. For example, the puck of the preferred embodiment has eight wheels 12, and therefore eight points of contact with the paved surface. When the puck travels in a particular direction along the paved surface, up to four wheels will be closely aligned with the direction of travel, thus exhibiting almost no friction with the paved surface because they will rotate about their axles. Several other wheels will be partially aligned to the direction of travel, and thus will rotate some and exhibit slight friction with the paved surface. The last few wheels will not be aligned in the direction of travel, and will therefore exhibit some friction with the paved surface as the wheels slide rather than roll along the playing surface. In summary, only a few of the eight points of contact will tend to slide rather than roll along the paved surface, thus producing an improved travel of the puck over the paved surface.

Unlike other pucks, the puck of the present invention has a tendency not to roll on its side. Because the wheels 12 on the leading edge of the puck rotate about an axis perpendicular to the direction of travel, there is no edge to catch the playing surface that could send the puck onto its side. If the puck is sent onto its side, the freely rotating wheels 12 will rotate to allow any forces acting upon the puck (such as gravity, a stick blade, etc.), or any puck momentum not directly aligned with the direction of travel, to bring the puck back down to a flat orientation. Unlike the prior art pucks, there is no edge or side for the puck to roll on. The rotating wheels decrease the friction between the puck's side and the playing surface such that the puck's behavior approximates that of an ice hockey puck being used on smooth ice. Further, the puck is less likely to accidentally flip up during stick handling as compared to other pucks. This is so because the blade of the stick engages wheels 12, not a firm puck side or edge. While stick handling with a conventional puck, the rising stick blade will sometimes flip the puck due to friction between the blade and the side or top edge of the puck and friction between the leading edge of the puck (opposite the blade) and the paved surface. With the present invention, a lifting stick blade will tend to roll off the wheels 12, instead of lifting the puck up by its side. Moreover, the reduced friction on the leading side of the puck helps keep the puck sliding on the playing surface, and not catching an edge or inducing the blade to flip the puck up onto its side or up into the air.

The puck of the present invention, however, can be intentionally lofted into the air by a player as easily as with a conventional puck. Lofting the puck is often desired when shooting at the goal or when attempting to pass the puck above an opponent's stick. The cylindrical shape of the wheels allows the stick blade to "scoop" the puck slightly from underneath the puck, making it easier to loft the puck into the air.

In the preferred embodiment, wheels 12 have a diameter of approximately 1.2 inches. This diameter has been found to best simulate the feel of an ice hockey puck, which is 1 inch in height. When a hockey player "dribbles" the puck, the stick blade typically contacts the upper circumferential puck edge at an angle of about 45 degrees. Since the preferred embodiment has no circumferential edge to contact, the blade contacts the wheels 12. A wheel diameter of 1.2 inches results in a blade at 45 degrees contacting the puck at a height of about one inch above the playing surface. It has also been found that a puck weight of 3.5–4.5 ounces, and an overall diameter of about 3 inches, makes the puck feel most like an ice hockey puck.

Puck stability is enhanced when the mass of the puck is concentrated around the circumference of the puck. The configuration of the preferred embodiment, with wheels 12 mounted near the outer circumference of the puck, greatly enhances the stability of the puck. To further concentrate the mass of the puck around its circumference, holes or depressions can be formed in the housing 10 at or near the puck's center.

Figure 3:
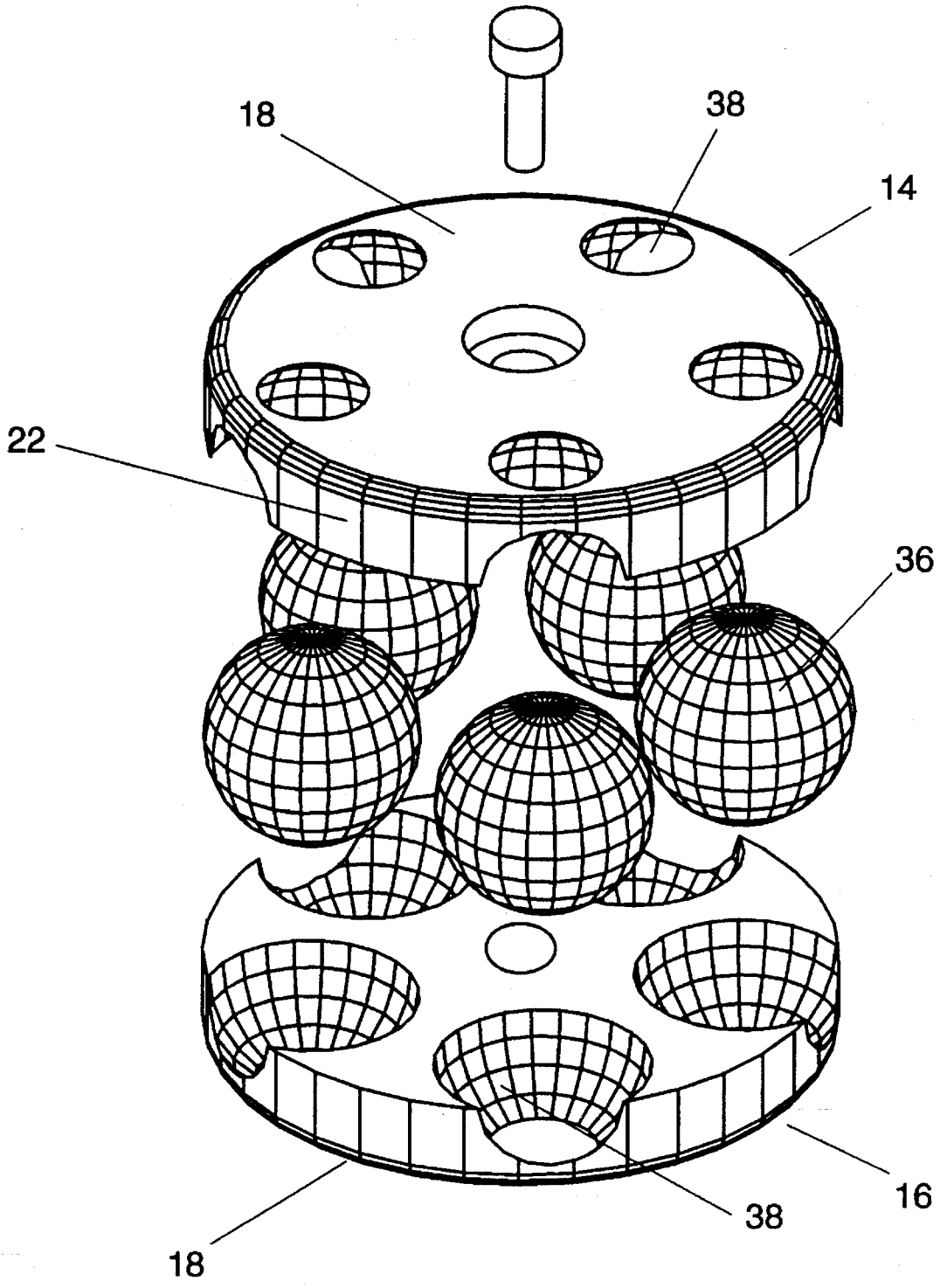
FIG. 3 is a perspective view of an alternate embodiment of the present invention which uses spherical rollers.

An alternate embodiment of the present invention is illustrated in FIG. 3. Spherical rollers 36 are used instead of the cylindrical wheels 12 of the preferred embodiment. Housing 10 forms a plurality of spherical cavities 38 that open onto both outer planar surfaces 18 as well as the side surface 22. The spherical rollers 36 contained in the spherical cavities 38 protrude through both planar surfaces 18 and the side wall 22, and freely rotate within the spherical cavities 38. The spherical rollers 38 reduce friction for puck travel on the playing surface, as well as prevent the puck from rolling on its side.

Figure 4A:
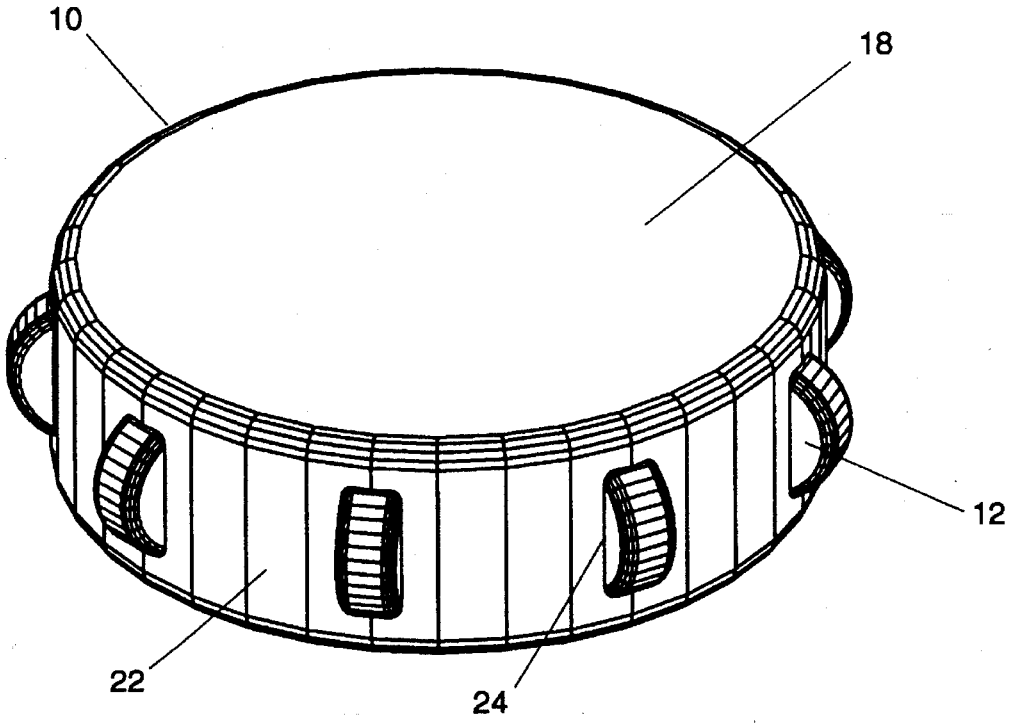
FIG. 4*a* is a perspective view of a second alternate embodiment of the present invention.
Figure 4B:
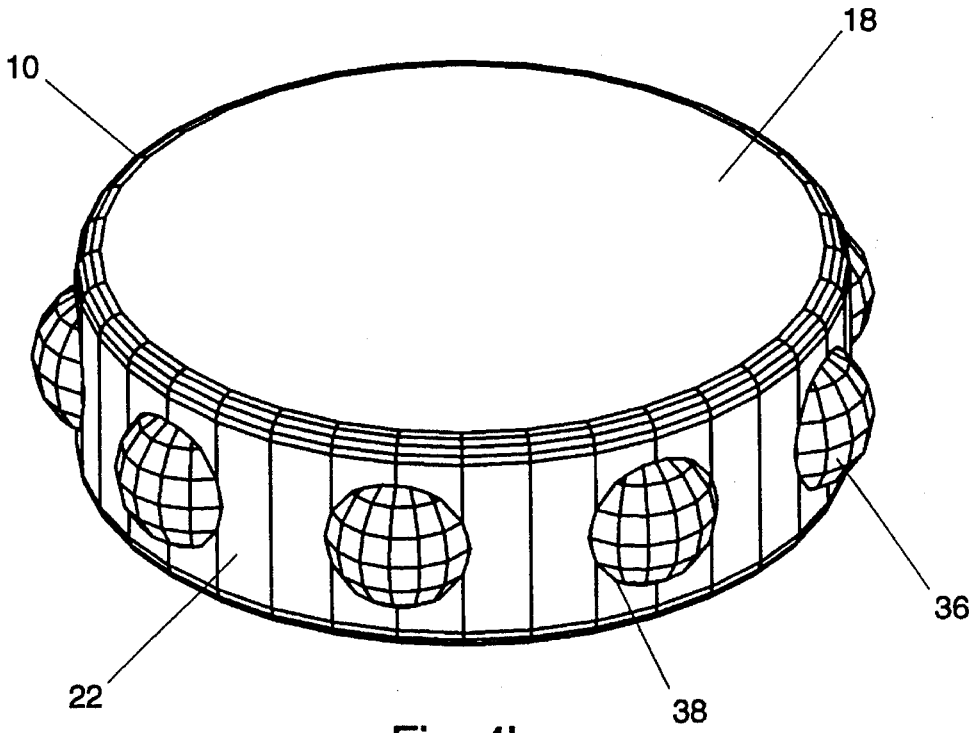
FIG. 4*b* is a perspective view of the second alternate embodiment of the present invention with spherical rollers.

A second alternate embodiment of the present invention is illustrated in FIGS. 4*a* and 4*b*. The rotatable members extend out of the side surface 22, but not out of the planar surfaces 18. The puck slides on the playing surface on either of the outer planar surfaces 18, and the rotatable members prevent the puck from rolling on its side surface 22. This embodiment is ideal for playing on smooth surfaces,, such as plastic tile, painted concrete, or wood, where the relatively smooth playing surface negates the need for rotatable members on the outer planar surfaces 18, but there still is a need for the rotatable members to prevent the puck from rolling on its side surface 22. This configuration reduces the amount of wear on the rotatable members. Alternately, runners or bumps can be used to decrease friction between the outer planar surfaces and the playing surface. The rotatable members can be either cylindrical wheels 12 in slots 24, as illustrated in FIG. 4a, or spherical rollers 36 in spherical cavities 38, as illustrated in FIG. 4*b*.

Figure 5A:
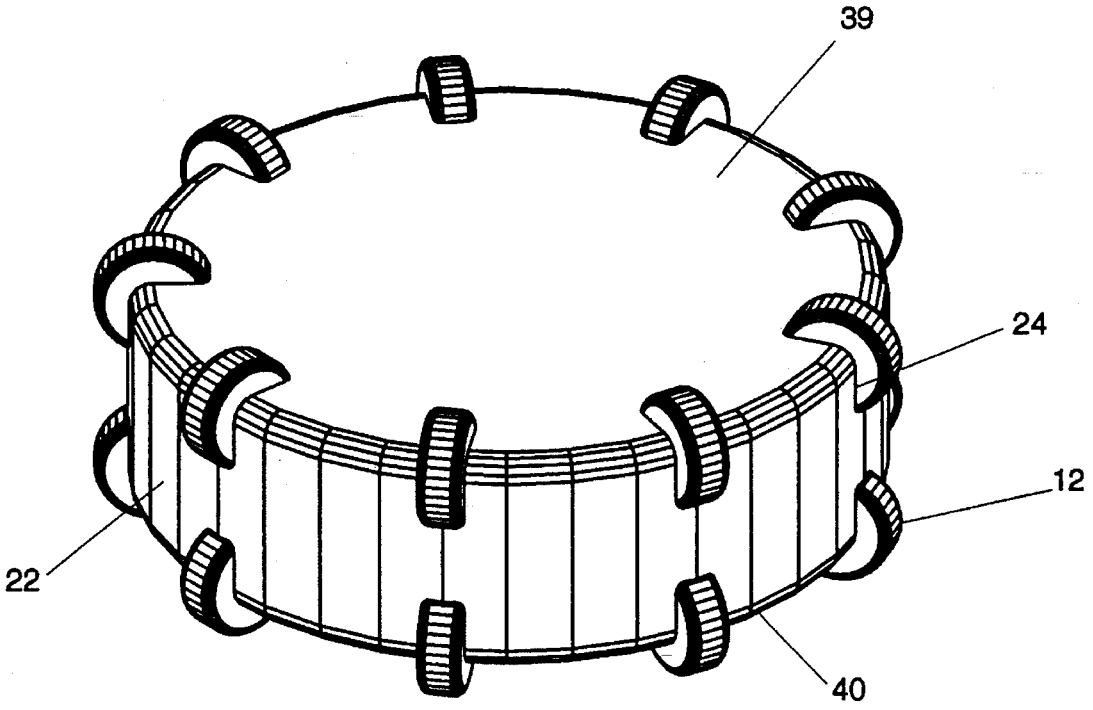
FIG. 5*a* is a perspective view of a third alternate embodiment of the present invention.
Figure 5B:
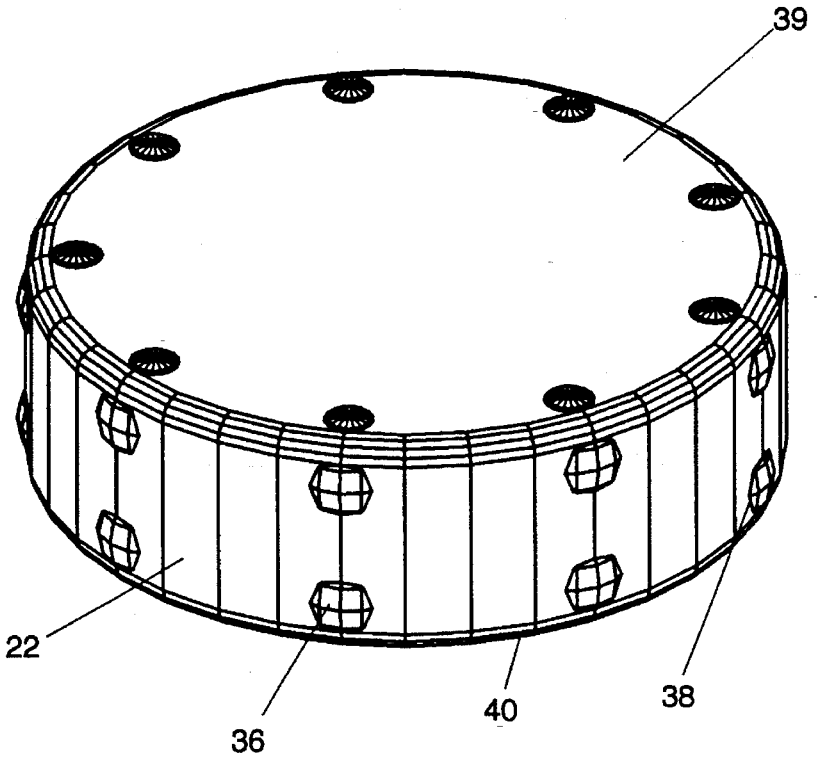
FIG. 5*b* is a perspective view of the third alternate embodiment of the present invention which uses spherical rollers.

A third alternate embodiment of the present invention is illustrated in FIGS. 5*a* and 5*b*. Two rows of rotatable members are mounted inside the puck. The first row of rotatable members is mounted to protrude through the upper planar surface 39 and the side surface 22, and the second row of rotatable members is mounted to protrude through the lower planar surface 40 and the side surface 22. The rotatable members can be smaller than the previous embodiments because they do not have to reach both the upper and lower planar surfaces 39/40. Further, this embodiment looks more like a traditional ice hockey puck. The rotatable members are smaller and the puck has a flat, cylindrical side wall. The rotatable members in this embodiment can be cylindrical wheels 12 in slots 24, as shown in FIG. 5*a*, or spherical rollers 36 in spherical cavities 38 shown in FIG. 5*b*.

Figure 6A:
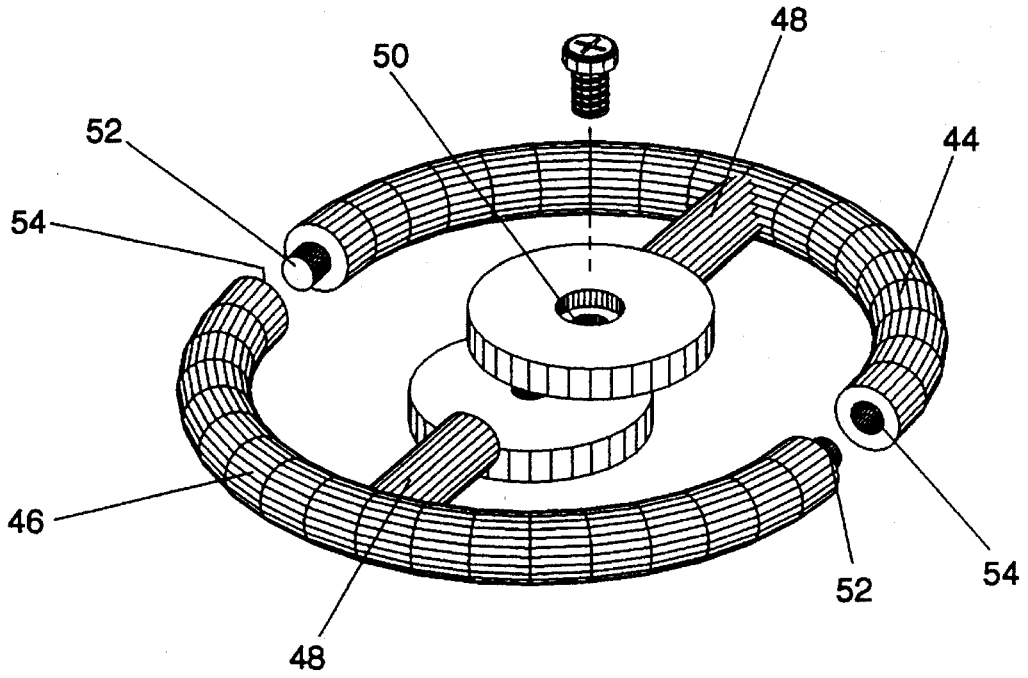
FIG. 6*a* is a partially exploded perspective view of the ring assembly of the fourth alternate embodiment of the present invention.
Figure 6B:
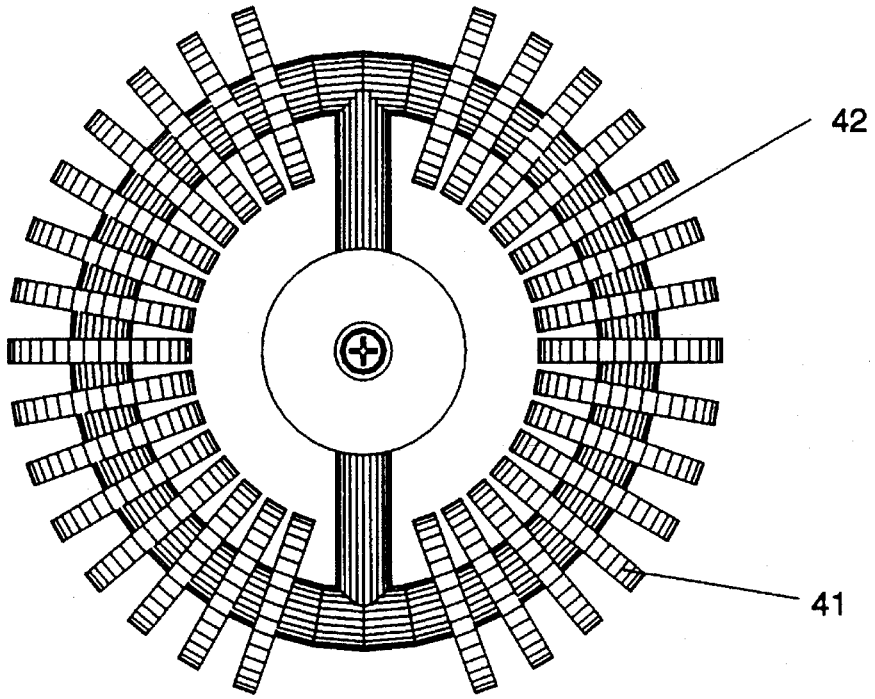
FIG. 6*b* is a top view of the fourth alternate embodiment of the present invention.

A fourth alternate embodiment of the present invention is illustrated in FIGS. 6*a* and 6*b*. Wheels 41 mount directly onto a ring assembly 42 to form the puck. The ring assembly 42 includes two half rings 44 and 46, each of which include a cross member 48 that terminates in an eyelet 50. The ring portion of each half ring 44/46 terminates at one end with a pin 52 and the other end in a pin hole 54. After the wheels 41 are mounted onto the half rings 44/46, the half rings 44/46 are pressed together such that the pins 52 engage the pin holes 54, and the eyelets 50 overlap each other. A fastener 56, such as a screw or rivet, mounts through the overlapped eyelets 50 to secure the half rings 44/46 together. The cross member also provides transverse support across the ring assembly 42 during use.

The ring assembly 42 forms the axle for each wheel 41 to rotate about. The ring assembly is preferably made of glass-reinforced plastic. The wheels 41 are preferably made of high-impact impact nylon with a metal center such that they freely rotate about the ring assembly 42. This embodiment would exhibit near-optimal mass distribution with most of the weight concentrated along the perimeter of the puck. Such mass distribution results in greatly enhanced puck stability.

It is to be understood that the present invention is not limited to the embodiments described above and illustrated herein, but encompasses any and all variations falling within the scope of the appended claims. For example the wheel axles need not be conical. Further, the number of wheels or rollers need not be eight. In addition, planar surfaces 18 need not be planar, nor even be solid surfaces, for those embodiments where the paved surface only contacts wheels 12 or rollers 36, and not housing 10. Finally, the structure used to support the cylindrical wheels in a ring configuration need not be the housing 10 or ring assembly 42 as illustrated above, but any structure that can support the wheels 12 in a ring configuration as shown in the above embodiments.

What is claimed is:

1. A hockey puck, comprising:

a first plurality of wheels; and support means having a central axis for supporting said wheels around said central axis, each of said wheels having an axis of rotation that is substantially perpendicular to a first plane containing both said central axis and a radius formed between said central axis and said wheel.

2. The hockey puck of claim 1 wherein said wheels are supported substantially equidistant from said central axis in a second plane that is perpendicular to said central axis.

3. The hockey puck of claim 2 wherein said support means includes a substantially disk-shaped housing having a top surface and a bottom surface separated by an outwardly facing side surface, said housing forming a plurality of slots extending radially inward from said side surface towards said central axis, said plurality of wheels being rotatably mounted in said slots.

4. The hockey puck of claim 3 wherein said housing is defined by two substantially disk-shaped sub-members each having an inner face and one of said top and bottom surfaces, said inner faces abutting one another and are held together with at least one fastening means therebetween.

5. The hockey puck of claim 3 wherein said plurality of wheels are cylindrical in shape with axles extending from the side walls thereof, said housing including mounting means in said slots for rotatably mounting said axles to said housing.

6. The hockey puck of claim 5 wherein said wheel axles are conical in shape, and said mounting means includes a pair of axle cavities of conical shape in said slots for engaging said conical wheel axles.

7. The hockey puck of claim 6 wherein said wheels having a circumference which extends out of said slots through said side surface.

8. The hockey puck of claim 7 wherein said circumference of said wheels extends out of said slots through said top and bottom surfaces.

9. The hockey puck of claim 3 further comprising:

a second plurality of wheels supported by said housing such that said second plurality of wheels are supported equidistant from said central axis in a third plane that is parallel to said second plane, wherein said first plurality of wheels extend through said side surface and said top surface, and said second plurality of wheels extend through said side surface and said bottom surface.

10. The hockey puck of claim 2 wherein said support means is a ring and said ring serving as said axis of rotation of said wheels.

11. The hockey puck of claim 10 further comprising:

a cross member that attaches across the diameter of said ring.

12. The hockey puck of claim 10 further comprising:

at least two cross members that are attachable together at the center of said ring and extend to the perimeter of said ring.

13. The hockey puck of claim 12 wherein said ring comprises a plurality of ring segments that are attachable together to form said ring.

14. The hockey puck of claim 13 wherein said cross members extend from said ring segments, said cross members being attachable together when said ring segments are attached together.

15. A hockey puck comprising:

a substantially disk-shaped housing having a top surface and a bottom surface separated by an outwardly facing side surface, said housing forming a first plurality of spherical cavities that open through said side surface and at least one of said top and bottom surfaces; and a first plurality of spherical rollers disposed in said first plurality of spherical cavities, said rollers freely rotatable inside said cavities, said rollers protruding through said side surface and at least one of said top and bottom surfaces.

16. The hockey puck of claim 15 wherein each of said cavities open onto said side surface and both of said top and bottom surfaces, and each of said rollers protrudes through said side surface and both of said top and bottom surfaces.

17. The hockey puck of claim 15, further comprising:

a second plurality of spherical cavities formed by said housing, said first plurality of cavities opening through said side surface and said top surface, and said second plurality of cavities opening through said side surface and said bottom surface, and a second plurality of spherical rollers disposed in said second plurality of spherical cavities, said first plurality of spherical rollers protruding through said side surface and said top surface, and said second plurality of spherical rollers protruding through said side surface and said bottom surface.

18. A hockey puck comprising:

a substantially disk-shaped housing having a top and a bottom surfaces separated by an outwardly facing side surface, said housing forming a plurality of spherical cavities that open onto said side surface; and a plurality of spherical rollers disposed in said cavities, said rollers freely rotatable inside said cavities and protruding through said side surface.

19. A hockey puck, comprising:

a substantially puck shaped body with a top surface, a bottom surface, and a circumferential surface;

a first plurality of rotating members; and means for mounting said rotating members to project through said circumferential surface and at least one of said top and bottom surfaces.

20. The hockey puck of claim 19 further comprising a second plurality of rotating members, said first plurality of said rotating members projecting through said circumferential surface and said top surface, and said second plurality of said rotating members projecting through said circumferential surface and said bottom surface.

21. The hockey puck of claim 19 wherein the rotating members are cylindrical wheels, each of said wheels having an axis of rotation that is substantially perpendicular to a first plane containing both said central axis and a radius formed between said central axis and said wheel.

22. The hockey puck of claim 21 wherein said wheels are supported substantially equidistant from said central axis in a second plane that is perpendicular to said central axis.

23. The hockey puck of claim 22 wherein said circumference of said wheels extends out through said top and bottom surfaces.

24. The hockey puck of claim 19 wherein the rotating members are spherical rollers.

25. A hockey puck, comprising:

a first plurality of wheels;

a substantially disk-shaped housing having a central axis, and a top surface and a bottom surface separated by an outwardly facing side surface, said housing forming a plurality of slots extending radially inward from said side surface towards said central axis, said plurality of wheels being rotatably mounted in said slots such that each of said wheels has an axis of rotation that is substantially perpendicular to a first plane containing both said central axis and a radius formed between said central axis and said wheel;

said plurality of wheels are substantially cylindrical in shape with axles extending from the side walls thereof, said housing including mounting means in said slots for rotatably mounting said axles to said housing wherein said wheels are supported substantially equidistant from said central axis in a second plane that is perpendicular to said central axis; and said housing being defined by two substantially disk-shaped sub-members each having an inner face and one of said top and bottom surfaces, said inner faces abutting one another and are held together with at least one fastener therebetween and with a plurality of pins extending between said sub-members near said side surface.

* * * * *